US007123279B2

(12) United States Patent
Lee

(10) Patent No.: US 7,123,279 B2
(45) Date of Patent: Oct. 17, 2006

(54) THERMAL TRANSFER PRINTING METHOD AND APPARATUS

(75) Inventor: Hyun-jun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 123 days.

(21) Appl. No.: 10/864,872

(22) Filed: Jun. 10, 2004

(65) Prior Publication Data

US 2005/0062833 A1 Mar. 24, 2005

(30) Foreign Application Priority Data

Jun. 11, 2003 (KR) ..... 10-2003-0037456

(51) Int. Cl.
*B41J 2/355* (2006.01)

(52) U.S. Cl. ..... 347/180

(58) Field of Classification Search ..... 347/180, 347/181, 182; 400/120.05, 120.06
See application file for complete search history.

(56) References Cited

U.S. PATENT DOCUMENTS 6,606,108 B1 * 8/2003 Lee ..... 347/195

FOREIGN PATENT DOCUMENTS

| | | |
|---|---|---|
| JP | 1995-7223329 | 8/1995 |
| JP | 2000-166586 | 6/2000 |
| KR | 1990-014137 | 10/1990 |
| KR | 2002-014363 | 2/2002 |

* cited by examiner

*Primary Examiner*—Huan Tran
(74) *Attorney, Agent, or Firm*—Roylance, Abrams, Berdo & Goodman, L.L.P.

(57) ABSTRACT

A thermal transfer printing method and apparatus. The thermal transfer printing method of printing each main line in a unit of a block comprises uniting a plurality of critical data, which exists in the same order in each of the blocks in each of the main lines composing a unit page, to one another, storing the uniting results as a plurality of sub-line data and printing the plurality of stored sub-line data, wherein each of the plurality of critical data is data obtained by dividing data included in each of the blocks by the number of critical dots and each of the plurality of critical data has a number of dots less than or equal to the number of critical dots.

12 Claims, 7 Drawing Sheets

THERMAL TRANSFER PRINTING METHOD AND APPARATUS

PRIORITY

This application claims the benefit under 35 U.S.C. §119 (a) of Korean Patent Application No. 2003-37456, filed on Jun. 11, 2003, in the Korean Intellectual Property Office, the entire disclosure of which is incorporated herein by reference.

BACKGROUND OF THE INVENTION

1. Field of the Invention

The present invention relates to thermal transfer printing. More particularly, the present invention relates to a thermal transfer printing method and apparatus requiring low rating.

2. Description of the Related Art

In general, in a thermal transfer printing method, each main line is printed in a unit of a block such that the thermal transfer printing method is suitable for use in a small-sized printing apparatus, such as a portable printer. However, in the thermal transfer printing method, printing data received from a personal computer (PC) must be converted into heat so that heat is transferred to a thermosensitive film and data is printed on a sheet of paper in a unit of a main line. Thus, in a conventional thermal transfer printing method, a considerably large amount of energy is consumed at a single instant. For example, when the number of dots per inch is 300 and a unit main line is comprised of four blocks, assuming that the number of dots included in each block is 720 and power consumption per dot is 0.26 watts, the maximum amount of power consumed during printing in each block is 187.2 watts and the maximum amount of power consumed during printing in each line is 748.8 watts. Accordingly, when a large amount of data is included in each line, a considerably large amount of power is consumed at a single instant such that the rating of a portable printer using a conventional thermal transfer printing method may be over 190 watts.

Consequently, a printing apparatus using the conventional thermal transfer printing method, which consumes a large amount of energy at a single instant, requires a DC power supply unit (or AC/DC power adaptor) having large rating. In this case, as the rating of the printing apparatus increases, the size of the DC power supply unit increases. Thus, a user using a portable printer applying the conventional thermal transfer printing method needs to carry a heavy and bulky DC power supply unit. Further, due to an increase in maximum power consumption caused by an increase in the amount of data, when the printing apparatus using the conventional thermal transfer printing method uses a common battery with another apparatus, such as a portable and personal printer, the battery capacity of the printing apparatus must be increased so that power required by another apparatus is supplied when the printing apparatus requires a large amount of energy at a single instant.

SUMMARY OF THE INVENTION

The present invention provides a thermal transfer printing method and apparatus to reduce the level of maximum instantaneous power consumed at a single instant during printing.

According to an aspect of the present invention, there is provided a thermal transfer printing method of printing each main line in a unit of a block, the method comprising uniting a plurality of critical data, which exists in the same order in each of the blocks in each of the main lines composing a unit page, to one another, storing the uniting results as a plurality of sub-line data and printing the plurality of stored sub-line data. Each of the plurality of critical data may be data obtained by dividing data included in each of the blocks by the number of critical dots, and each of the plurality of critical data may have a number of dots less than or equal to the number of critical dots.

According to another aspect of the present invention, there is provided a thermal transfer printing apparatus for printing each main line in a unit of a block, wherein a plurality of critical data existing in the same order in each of the blocks in each of the main lines composing a unit page are united to one another, the uniting results are stored as a plurality of sub-line data, and the plurality of stored sub-line data are printed. Each of the plurality of critical data may be data obtained by dividing data included in each of the blocks by the number of critical dots, and each of the plurality of critical data may have a number of dots less than or equal to the number of critical dots.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numerals refer to like features and structures.

DETAILED DESCRIPTION OF THE INVENTION

Hereinafter, a thermal transfer printing method according to embodiments of the present invention will be described in detail with reference to the attached drawings.

In the thermal transfer printing method according to an embodiment of the present invention, a plurality of critical data existing in the same order in each of the blocks in each of the main lines composing a unit page to be printed are united to one another, the united result is stored as sub-line data, and the plurality of stored sub-line data are sequentially printed. Here, the critical data is data generated by dividing data d included in each block by the number of critical dots. The critical data has the number of dots less than or equal to the number of critical dots that can be varied by a user. In other words, a maximum number of dots of the critical data is the number of critical dots. In this case, data included in each block is the number of dots that contribute to a thermal transfer in each block. For example, when data in a dot is 0, the dot does not contribute to thermal transfer. When data in a dot is 1, the dot contributes to thermal transfer.

As described above, each block may have a plurality of critical data. In this case, in the thermal transfer printing method according to an embodiment of the present invention, a plurality of first critical data in each block are united to one another to compose first sub-line data, which is then stored, and a plurality of second critical data in each block are united to one another to compose second sub-line data, which is then stored. In this manner, in the thermal transfer printing method, a plurality of critical data existing in the same order are united to one another to compose sub-line data, and the sub-line data is then stored.

In this case, according to an embodiment of the present invention, in the thermal transfer printing method, when all of a plurality of sub-line data is composed, in other words, all of a plurality of critical data existing in the same order in each block are united to one another, and sub-line data from first sub-line data to last sub-line data is sequentially printed one by one. According to another embodiment of the present invention, in the thermal transfer printing method, sub-line data composed whenever one sub-line data is composed, is printed, and thereafter, the sub-line data from the first sub-line data to the last sub-line data is sequentially printed one by one.

Consequently, in the thermal transfer printing method according to an embodiment of the present invention, maximum instantaneous consumption power P is obtained using Equation 1.

$$P=N_T P_U \quad (1)$$

Here, $N_T$ is the number of critical dots, and $P_U$ is power consumed when a unit dot is printed.

Figure 1:
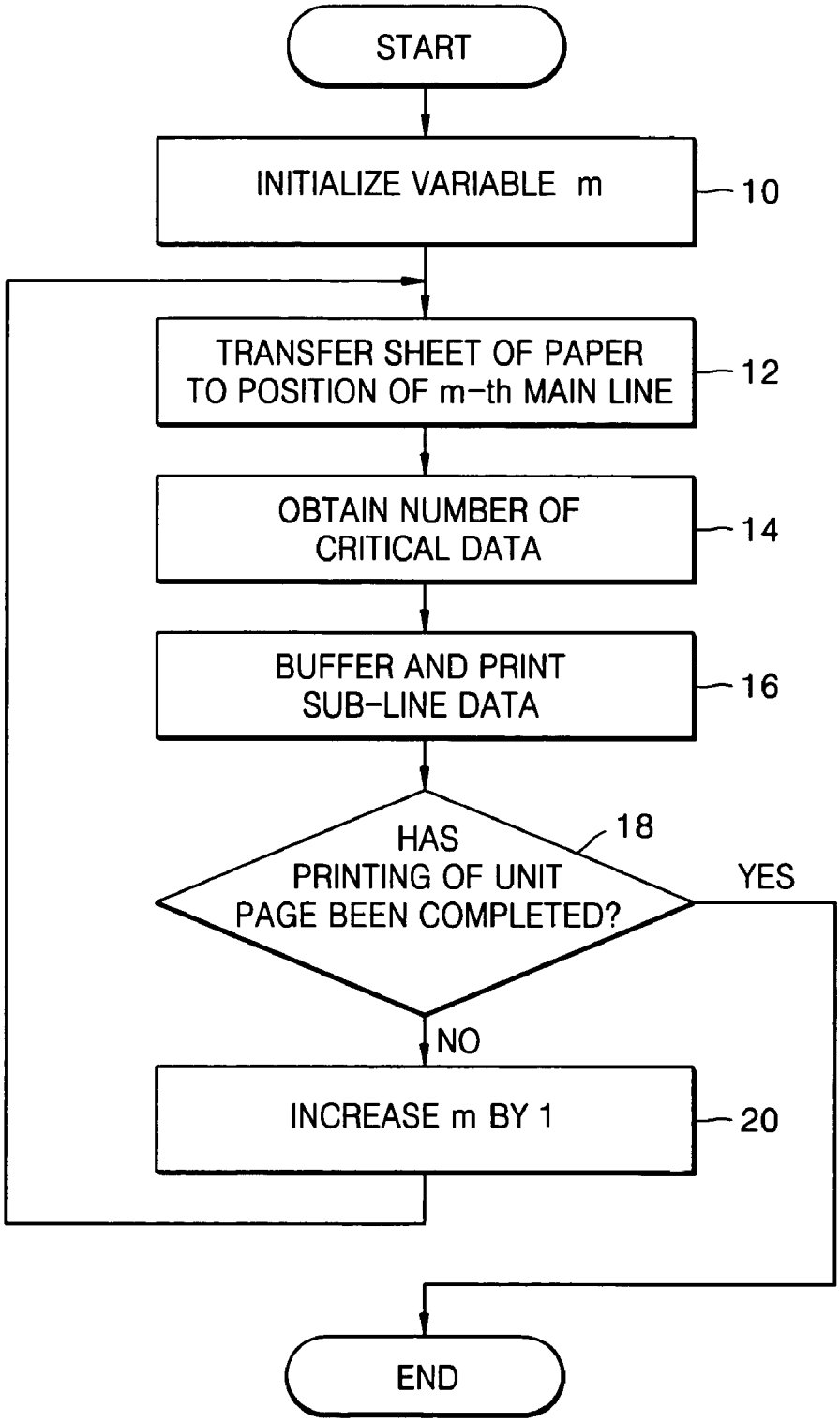
FIG. 1 is a flowchart illustrating a thermal transfer printing method according to an embodiment of the present invention.

FIG. 1 is a flowchart illustrating a thermal transfer printing method according to an embodiment of the present invention. Referring to FIG. 1, the thermal transfer printing method includes transferring a sheet of paper and obtaining the number of critical data included in each block (steps 10 through 14), buffering and printing sub-line data (step 16), and adjusting m depending on whether printing of a unit page has been completed (steps 18 and 20).

In the thermal transfer printing method according to an embodiment of the present invention, in step 10, a variable m that identifies main lines, that is, the variable m representing the number assigned to each main line, is initialized. For example, the variable m is initialized as 1.

In step 12, the sheet of paper is transferred to a position of an m-th main line, which is one of the main lines. In step 14, the number of critical data included in each block composing the m-th main line is obtained. In other words, each block may provide at least one critical data, and the number of critical data included in each block is obtained in step 14.

For example, when the amount of data included in a block is 720 dots, and the number of critical dots is 100, there are 7 sets of critical data having 100 dots, and 1 remaining set of critical data having the remaining 20 dots. In other words, the total number of sets of critical data included in the block is 8.

Figure 2:
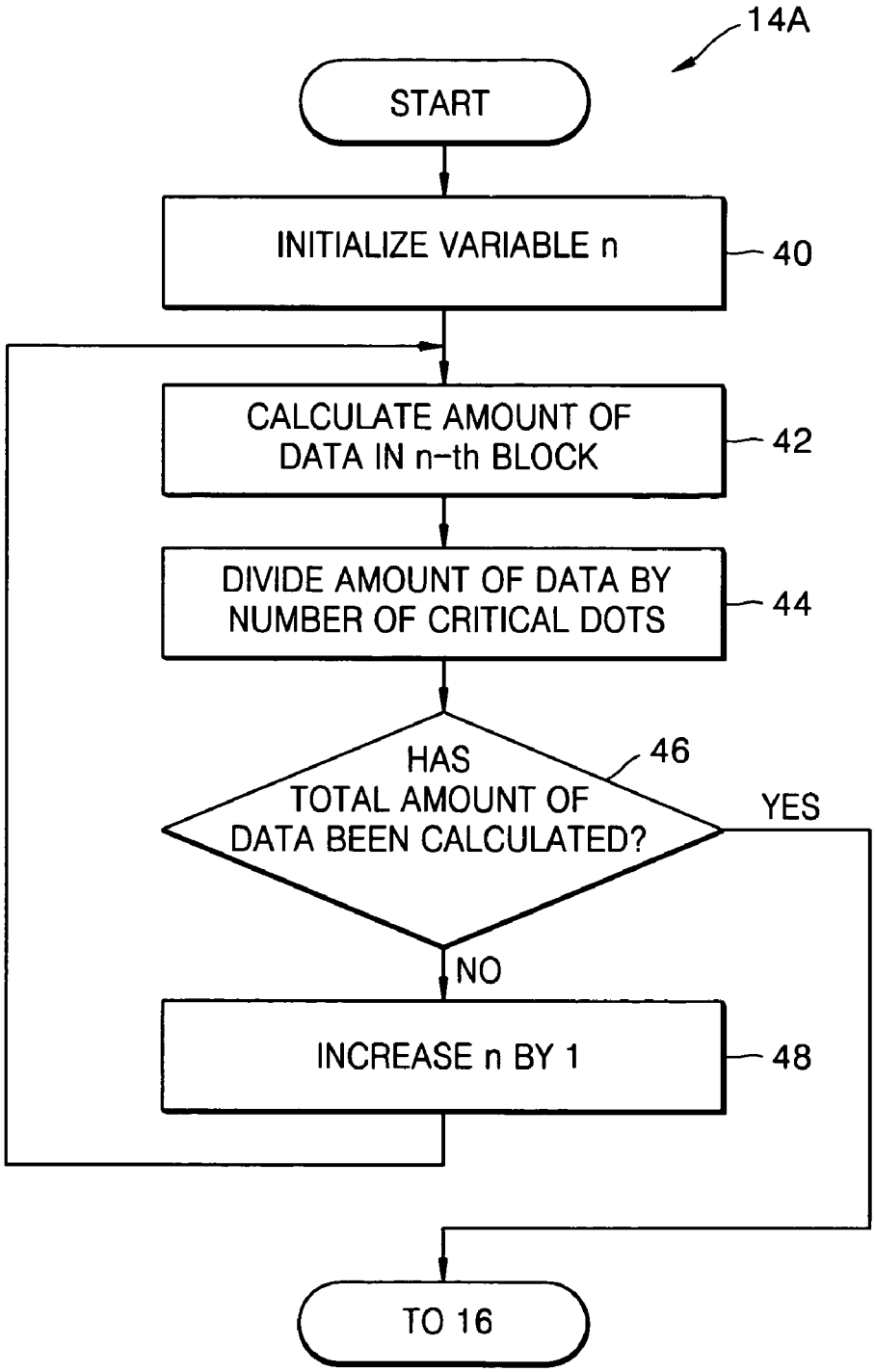
FIG. 2 is a flowchart illustrating step 14 shown in FIG. 1, according to an embodiment of the present invention.

FIG. 2 is a flowchart illustrating step 14 shown in FIG. 1, according to an embodiment of the present invention. Step 14A includes calculating the amount of data in each block (steps 40 through 48).

In step 40, a variable n that identifies blocks composing the m-th main line, that is, the variable n representing the number assigned to each block, is initialized. For example, the variable n may be initialized as 1.

After step 40, in step 42, the amount of data in an n-th block is calculated. Here, the amount of data in the n-th block is the number of dots which contribute to a thermal transfer in the n-th block.

In step 44, the calculated amount of data in the n-th block is divided by the number of critical dots. In this case, a division result may be stored, and the number of sets of critical data included in the n-th block corresponds to the lowest number among integer numbers greater than the division result in step 44. For example, when the division result is 7.45, the number of sets of critical data is 8.

In step 46, it is determined whether the total amount of data in the blocks composing the m-th main line has been calculated. If it is determined that the total amount of data in the blocks composing the m-th main line has been calculated, the method proceeds to step 16.

However, if it is determined that the total amount of data in the blocks composing the m-th main line has not been calculated, in step 48, the variable n is increased by 1, and the method proceeds to step 42.

Meanwhile, after step 14, in step 16, using the number of critical data in each block, a plurality of critical data included in each of the blocks is united to one another in the same order and are buffered as sub-line data, and the buffered sub-line data is printed.

Figure 3:
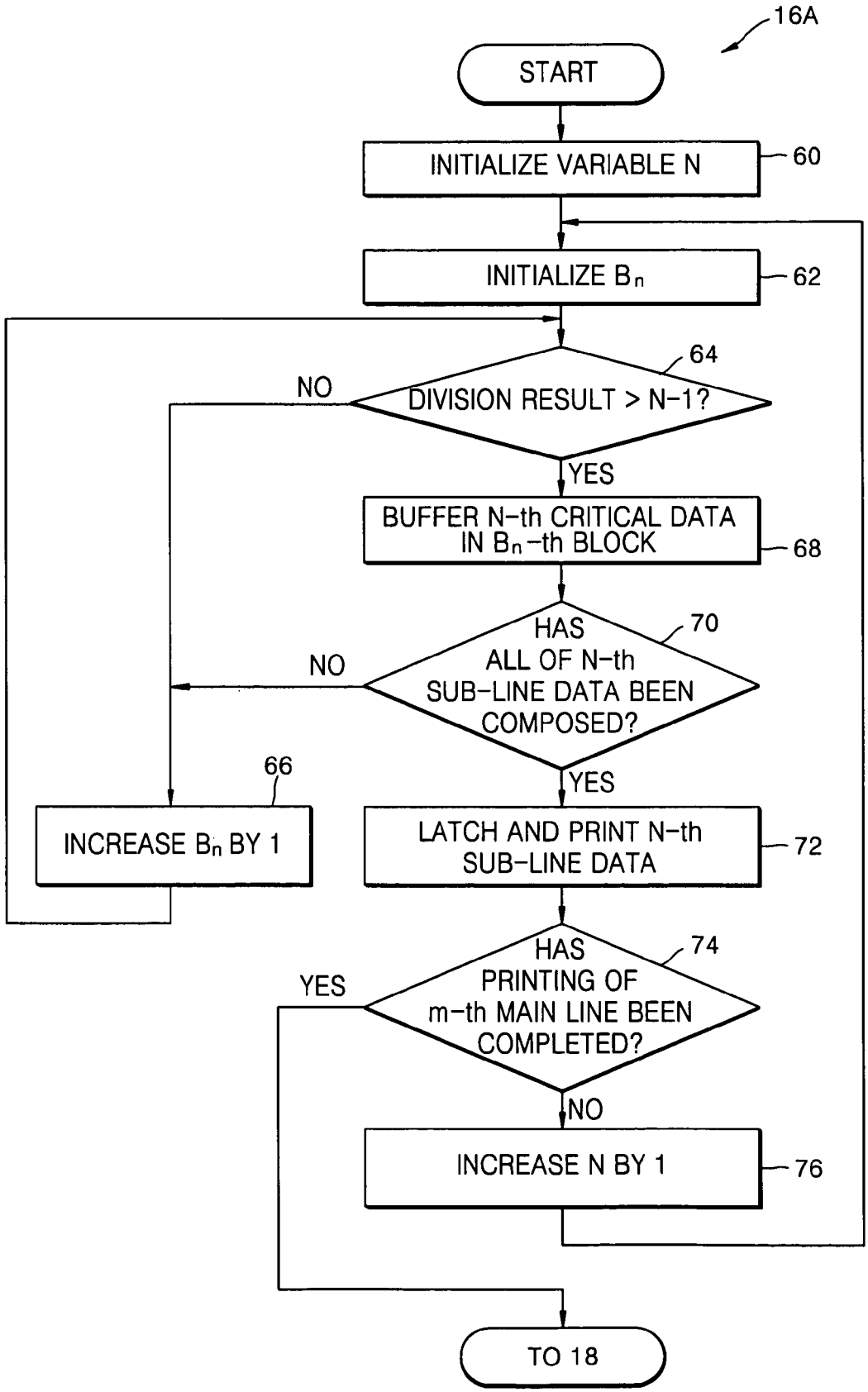
FIG. 3 is a flowchart illustrating step 16 shown in FIG. 1, according to an embodiment of the present invention.

FIG. 3 is a flowchart illustrating step 16 shown in FIG. 1, according to an embodiment of the present invention. Step 16A includes initializing a variety of variables (steps 60 and 62), composing N-th sub-line data (steps 64 through 70), printing the N-th sub line data (step 72), and adjusting N depending on whether printing of a main line has been completed (steps 74 and 76).

According to an embodiment of the present invention, after step 14, in step 60, a variable N that identifies sub-line data, that is, the variable N representing the number assigned to the sub-line data, is initialized. For example, the variable N may be initialized as 1.

After step 60, in step 62, a variable $B_n$ that identifies blocks composing the m-th main line, that is, the variable $B_n$ representing the number assigned to each block composing the m-th main line, is initialized. For example, the variable $B_n$ may be initialized as '1'.

After step 62, in step 64, it is determined whether a division result in step 44 shown in FIG. 2 is greater than N−1.

If it is determined that the division result in step 44 is less than or equal to N−1, in step 66, the variable $B_n$ is increased by 1, and the method proceeds to step 64. However, if it is determined that the division result in step 44 is greater than N−1, in step 68, N-th critical data in a $B_n$-th block among the blocks is buffered.

In step 70, it is determined whether all of N-th sub-line data among the sub-line data has been composed. In other words, it is determined whether all of the N-th critical data in each block composing the N-th sub-line data has been buffered. If it is determined that all of N-th sub-line data has not been composed, in step 66, the variable $B_n$ is increased by 1, for buffering the N-th critical data in a subsequent block. However, if it is determined that all of the N-th sub-line data has been composed, in step 72, the N-th sub-line data comprised of the N-th critical data in each block is latched and printed.

In this case, for a better understanding of steps 64 through 72 of composing, latching and printing the N-th sub-line data, an example will now be provided. Assuming that N=1, the m-th main line is comprised of a single block or a plurality of blocks, the number of data included in a first block is 720, and the number of critical dots is 100, the division result in step 44 is 7.2. In this case, after steps 60 and 62 are performed, since it is determined in step 64 that the division result of 7.2 is greater than 0, in step 68, first (N=1) critical data in a first ($B_n$=1) block is buffered. Since it is determined in step 70 that all of the first sub-line data has not been composed, that is, since the N-th critical data existing in other blocks excluding the first block is not buffered, in step 66, $B_n$ is increased by '1' and is changed to 2, and the method proceeds to step 64. In this case, assuming that the number of data included in a second block is 500, the division result in step 44 is 5, and 5 is determined in step 64 to be greater than 0. Thus, in step 68, the first (N=1) critical data in a second ($B_n$=2) block is buffered, and the method proceeds to step 70. In this manner, steps 64, 66, 68, and 70 are repeated so that all of the first (N=1) critical data in each block existing in the m-th main line is buffered. Here, the first sub-line data is comprised of first critical data in each block existing in the m-th main line. Thus, if it is determined that all of the first sub-line data has been composed, a result in which all of the first sub-line data, that is, all of first critical data in all blocks of the m-th main line is buffered, is latched, and a latching result is printed.

Meanwhile, in step 74, it is determined whether printing of the m-th main line has been completed. Here, data existing in the m-th main line is comprised of at least one sub-line data, and N-th sub-line data is comprised of N-th critical data in each of the blocks composing each main line. Thus, in step 74, it is determined whether all of sub-line data composing data existing in the m-th main line has been printed.

If it is determined that printing of the m-th main line has been completed, the method proceeds to step 18. However, if it is determined that printing of the m-th main line has not been completed, in step 76, N is increased by 1, and the method proceeds to step 62. Thus, a plurality of second (N=2) critical data in all blocks of the m-th main line are united to one another, buffered, and printed. In this manner, a plurality of the remaining sub-line data can be obtained.

Figure 4:
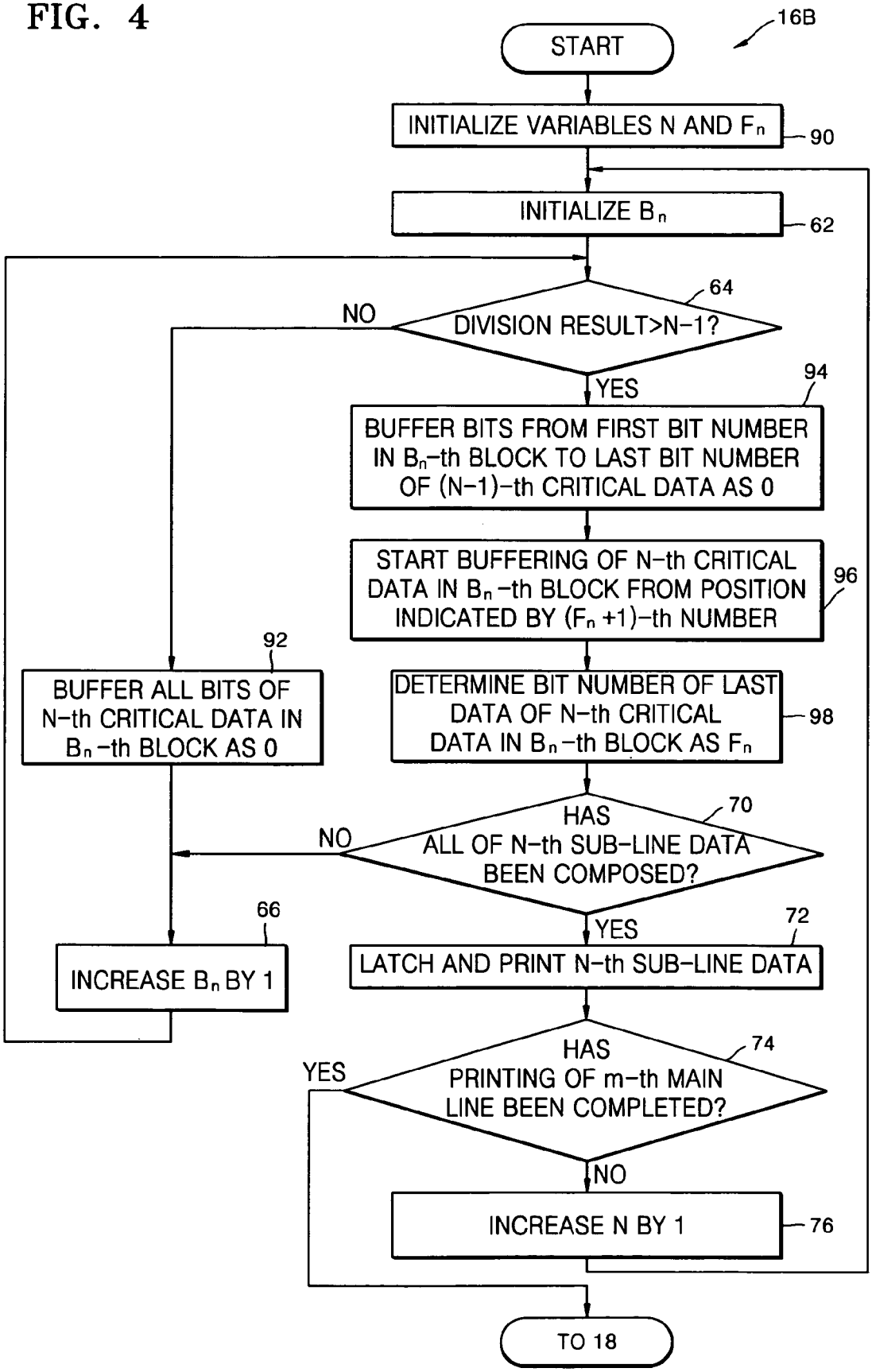
FIG. 4 is a flowchart illustrating step 16 shown in FIG. 1, according to another embodiment of the present invention.

FIG. 4 is a flowchart illustrating step 16 shown in FIG. 1, according to another embodiment of the present invention. Step 16B includes initializing a variety of variables (steps 90 and 62), composing N-th sub-line data (steps 92 through 98, steps 64, 66, and 70), printing the N-th sub line data (step 72), and adjusting N depending on whether printing of a main line is completed (steps 74 and 76).

In the embodiment 16B shown in FIG. 4, each of the steps in performing the same functions as those of the embodiment 16A shown in FIG. 3 refers to the same reference numerals shown in FIG. 3, and detailed descriptions thereof will be omitted.

According to another embodiment of the present invention, after step 14, in step 90, variables N and $F_n$ are initialized, and the method proceeds to step 62. Here, the variable $F_n$ represents the number of bits to be buffered last among bits existing in N-th critical data in a $B_n$-th block. For example, the variables N and $F_n$ may be initialized as 1.

If it is determined that the division result in step 44 is less than or equal to N−1, there is no N-th critical data in the $B_n$-th block. Thus, in step 92, all bits of the N-th critical data are buffered as 0, and the method proceeds to step 66. In this case, a bit that does not substantially contribute to a thermal transfer is assumed as 0. However, if it is determined that the division result in step 44 is greater than N−1, in step 94, bits from a first bit number in the $B_n$-th block to a last bit number of a (N−1)-th critical data are buffered as '0'.

In step 96, buffering of the N-th critical data in the $B_n$-th block starts from a position indicted by a ($F_n$+1)-th number of a buffer (not shown). In step 98, the last bit number of the N-th critical data in the $B_n$-th block is determined as a variable $F_n$, and the method proceeds to step 70.

Meanwhile, in step 18, it is determined whether printing of a unit page has been completed. If it is determined that printing of the unit page has not been completed, in step 20, m is increased by 1, and the method proceeds to step 12. Thus, steps 12 through 16 are performed on a subsequent main line. In this manner, after steps 12 through 16 are performed in all main lines of the unit page. If printing of the unit page is completed, the thermal transfer printing method shown in FIG. 1 is terminated.

Hereinafter, the structure and operation of a thermal transfer printing apparatus according to embodiments of the present invention will be described with reference to the attached drawings.

The thermal transfer printing apparatus according to an embodiment of the present invention performs the above-described thermal transfer printing method. In other words, the thermal transfer printing apparatus according to an embodiment of the present invention unites a plurality of critical data existing in the same order in each of the blocks existing in each of the main lines composing a unit page to be printed to one another, stores the plurality of united critical data as a plurality of sub-line data, and prints the plurality of stored sub-line data.

Figure 5:
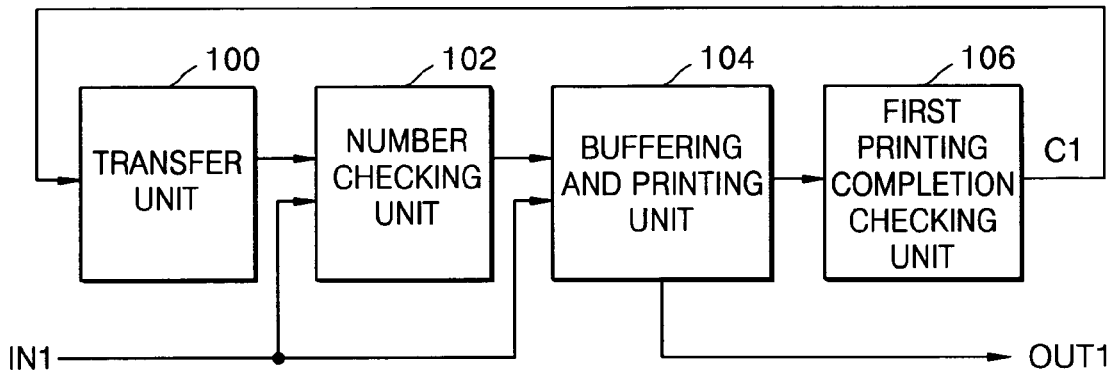
FIG. 5 is a block diagram of a thermal transfer printing apparatus according to an embodiment of the present invention.

FIG. 5 is a block diagram of a thermal transfer printing apparatus according to an embodiment of the present invention. Referring to FIG. 5, the thermal transfer printing apparatus includes a transfer unit 100, a number checking unit 102, a buffering and printing unit 104, and a first printing completion checking unit 106.

The thermal transfer printing apparatus shown in FIG. 5 can perform the thermal transfer printing method shown in FIG. 1.

The transfer unit 100 shown in FIG. 5 performs steps 10, 12, and 20 shown in FIG. 1. For example, in order to perform step 10, the transfer unit 100 initializes a variable m. In this case, in order to perform step 12, the transfer unit 100 drives a line feed motor (not shown) to transfer a sheet of paper to a position of an m-th main line among a plurality of main lines, in response to a first control signal C1 input from the first printing completion checking unit 106, and outputs a signal indicating that the sheet of paper has been completely transferred, to the number checking unit 102. In this case, the transfer unit 100 stops the line feed motor from operating until m is increased by 1.

In order to perform step 14, when it is recognized from the signal input from the transfer unit 100 to the number checking unit 102 that the sheet of paper has been completely transferred, the number checking unit 102 calculates the number of critical data from data which is included in each of the blocks composing the m-th main line and is included in each block input through an input terminal IN1, and outputs the calculated number of critical data in each block to the buffering and printing unit 104.

Figure 6:
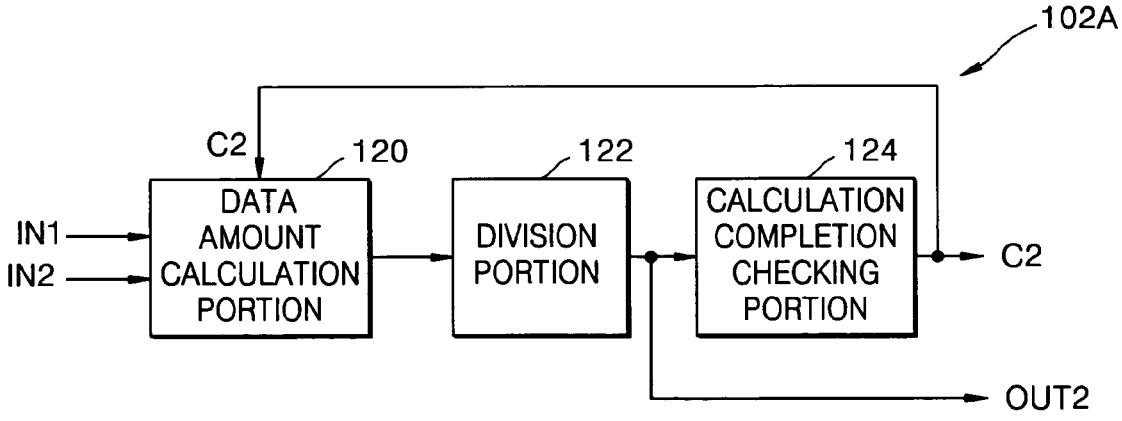
FIG. 6 is a block diagram of a number checking unit shown in FIG. 5, according to an embodiment of the present invention.

FIG. 6 is a block diagram of a number checking unit 102 shown in FIG. 5, according to an embodiment of the present invention. The number checking unit 102A includes a data amount calculating portion 120, a division portion 122, and a calculation completion checking portion 124.

The number checking unit 102A shown in FIG. 6 performs step 14A shown in FIG. 2. The data amount calculating portion 120 performs steps 40, 42, and 48. For example, in order to perform step 40, if a signal indicating that the sheet of paper has been completely transferred is input from the transfer unit 100 to the data amount calculating portion 120 through an input terminal IN2, the data amount calculating portion 120 of the number checking unit 102A initializes a variable n. In this case, in order to perform step 42, the data amount calculating unit 120 inputs data in an n-th bock among blocks existing in the m-th main line through the input terminal IN1 in response to a second control signal C2 input from the calculation completion checking portion 124, and calculates the amount of the input data.

In order to perform step 44, the division portion 122 divides the calculated amount of data in the n-th block input thereto from the data amount calculation portion 120 by the number of critical dots, outputs a division result to the buffering and printing unit 104 through an output terminal OUT2, and outputs the division result to the calculation completion checking portion 124.

In order to perform step 46, the calculation completion checking portion 124 checks through a division result input thereto from the division unit 122 whether the total amount of data in each of the blocks composing the m-th main line has been calculated and outputs a checking result as the second control signal C2 to the data amount calculation portion 120 and the buffering and printing unit 104. Thus, when it is recognized from the second control signal C2 that the total amount of data has not been calculated, in order to perform step 48, the data amount calculation unit 120 increases the variable n by 1. In addition, the data calculation unit 120 increases the variable n by 1 and then, in order to perform step 42, calculates the amount of data in the increased n-th block.

Meanwhile, in order to perform step 16 shown in FIG. 1, the buffering and printing unit 104 unites a plurality of critical data included in each of the blocks in the same order to one another using the number of critical data input from the number checking unit 102, buffers the uniting result as a plurality of sub-line data, prints the plurality of buffered sub-line data, outputs a printing result through an output terminal OUT1, and outputs a signal representing that printing is completed, to the first printing completion checking unit 106. In this case, when it is recognized that the total amount of data is calculated in response to the second control signal C2 input from the calculation completion checking portion 124 of the number checking unit 102A shown in FIG. 5, the buffering and printing unit 104 buffers the plurality of sub-line data.

Figure 7:
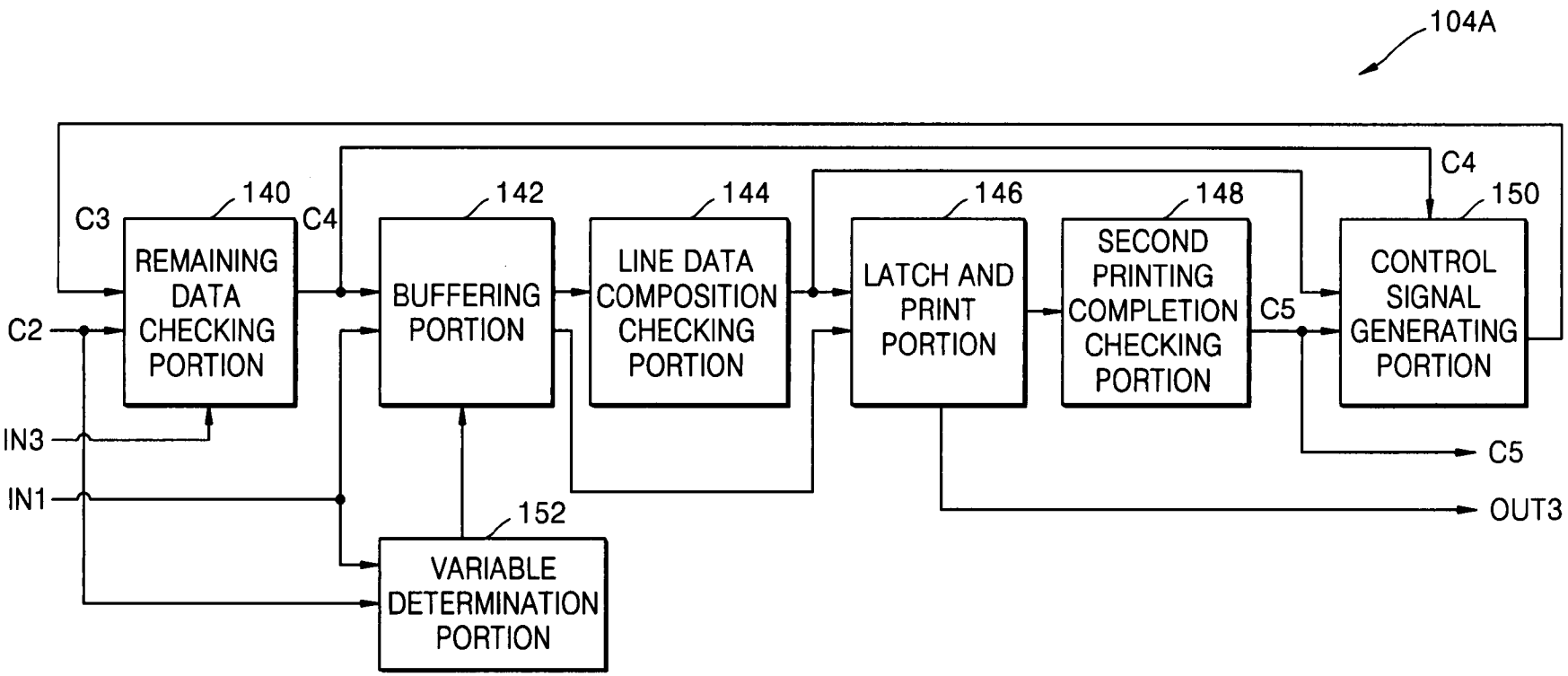
FIG. 7 is a block diagram of a buffering and printing unit shown in FIG. 5, according to an embodiment of the present invention.

FIG. 7 is a block diagram of a buffering and printing unit 104 shown in FIG. 5, according to an embodiment of the present invention. The buffering and printing unit 104A includes a remaining data checking portion 140, a buffering portion 142, a line data composition checking portion 144, a latch and print portion 146, a second printing completion checking portion 148, a control signal generating portion 150, and preferably includes a variable determination portion 152.

When the buffering and printing unit 104A shown in FIG. 7 does not include the variable determination portion 152, the buffering and printing unit 104A performs step 16A shown in FIG. 3. When the buffering and printing unit 104A shown in FIG. 7 includes the variable determination portion 152, the buffering and printing unit 104A performs step 16B shown in FIG. 4.

First, in order to perform step 16A shown in FIG. 3, the structure and operation of the buffering and printing unit 104A shown in FIG. 7 which does not provide the variable determination portion 152, will be described as below.

For example, in order to perform steps 60, 62, 64, 66, and 76, the buffering and printing unit 104A shown in FIG. 7 can provide the remaining data checking portion 140 and the control signal generating portion 150. Here, the remaining data checking portion 140 compares a division result input thereto from the division portion 122 through an input terminal IN3 with N−1 in response to the second control signal C2 input thereto from the calculation completion checking unit 124 shown in FIG. 6 and a third control signal C3 input thereto from the control signal generating portion 150 and outputs a comparison result as a fourth control signal C4 to the buffering portion 142 and the control signal generating portion 150, respectively. For example, in order to perform step 60, if it is recognized from the second control signal C2 input from the calculation completion checking portion 124 that the total amount of data in each of the blocks composing the m-th main line is calculated, the remaining data checking portion 140 initializes N. In this case, after N is initialized, in order to perform step 62, the remaining data checking portion 140 initializes $B_n$. In this case, in order to perform step 64, the remaining data checking portion 140 compares a division result input thereto through the input terminal IN3 with N−1 and outputs a comparison result as the fourth control signal C4. In this case, in order to perform step 66, the remaining data checking portion 140 adjusts a variable $B_n$ in response to the fourth control signal C4. In other words, if it is recognized from the fourth control signal C4 that the division result is less than or equal to N−1, the remaining data checking portion 140 increases the variable $B_n$ by 1.

In this case, in order to perform step 68, the buffering portion 142 inputs N-th critical data in a $B_n$-th block among the blocks included in the m-th main line through the input terminal IN1 to buffer the N-th critical data in response to the fourth control signal C4 input from the remaining data checking portion 140, outputs a buffering result to the latch and print portion 146, and outputs a signal representing that buffering is performed to the line data composition checking portion 144. For example, if it is recognized from the fourth control signal C4 that the division result is greater than N−1, the buffering portion 142 inputs the N-th critical data in the $B_n$-th block to buffer the N-th critical data.

Figure 8:
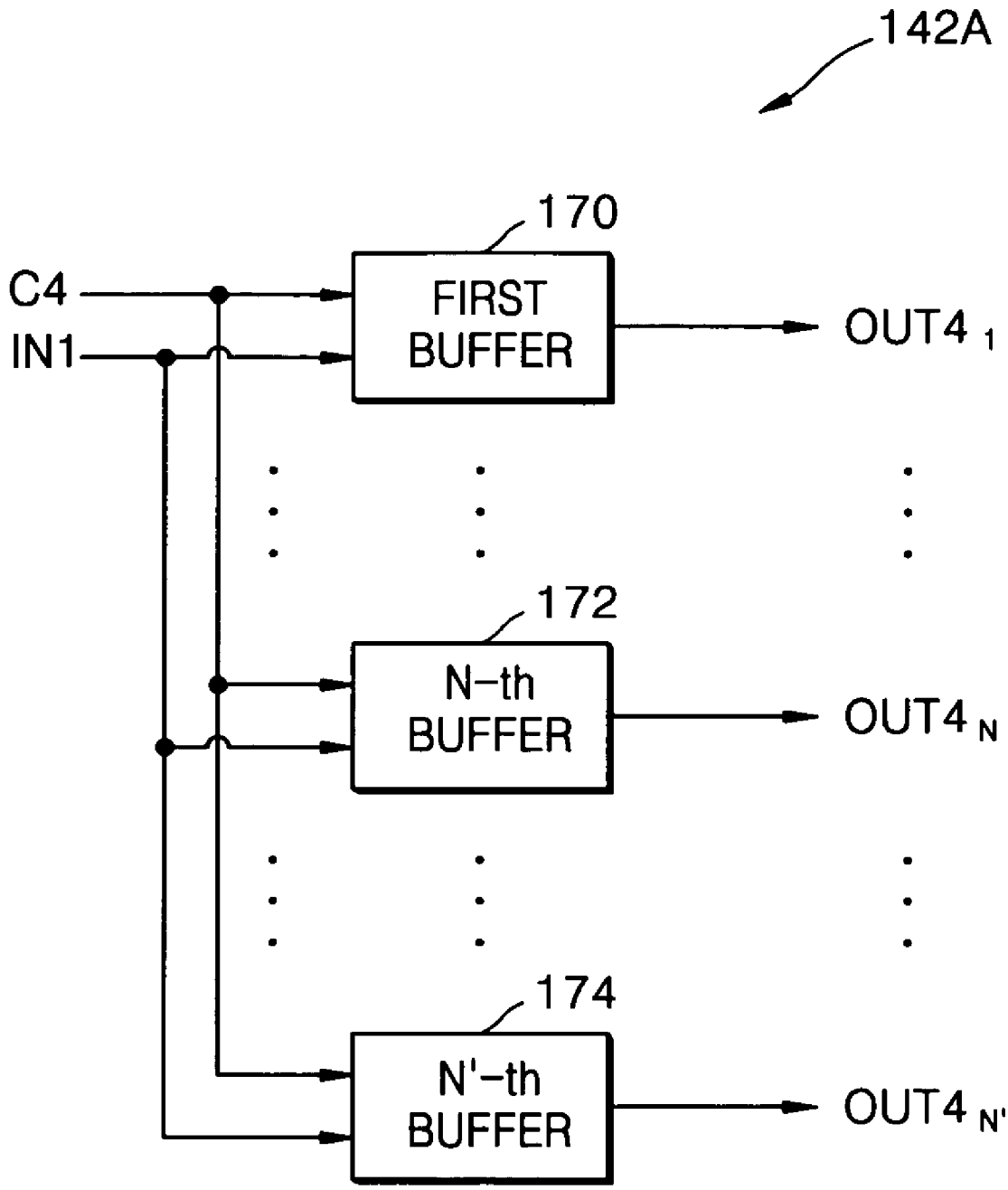
FIG. 8 is a block diagram of a buffering portion shown in FIG. 7, according to an embodiment of the present invention.

FIG. 8 is a block diagram of a buffering portion 142 shown in FIG. 7, according to an embodiment of the present invention. Referring to FIG. 8, the buffering portion 142A includes a plurality of buffers including a first buffer 170, an N-th buffer 172, and an N'-th buffer 174. Here, N' is the maximum number of critical data existing in each block.

According to an embodiment of the present invention, the N-th ($1 \leqq N \leqq N'$) buffer 170, 172, or 174 enabled in response to the fourth control signal C4 having information on N input from the remaining data checking portion 140 inputs the N-th critical data in the $B_n$-th block among the blocks included in the m-th main line through the input terminal IN1 to buffer the N-th critical data and outputs a buffering result through an output terminal $OUT4_N$. To this end, the remaining data checking portion 140 may include information on N in the fourth control signal C4 and may output the information to the buffering portion 142A. For example, if it is recognized from the fourth control signal C4 that N is initialized, that is, that N is set to 1, the first buffer 170 is enabled. In this case, only an enabled buffer among the first buffer 170, the N-th buffer 172, and the N'-th buffer 174 can buffer critical data input through the input terminal IN1. As such, when the buffering portion 142 shown in FIG. 7 is implemented as shown in FIG. 8, each buffer buffers sub-line data one by one. In other words, first sub-line data is buffered by the first buffer 170, N-th sub-line data is buffered by the N-th buffer 172, and N'-th sub-line data is buffered by the N'-th buffer 174.

According to another embodiment of the present invention, the buffering portion 142 shown in FIG. 7 may be implemented with only one buffer (not shown), unlike in FIG. 8. In this case, one buffer that serves as the buffering portion 142 buffers one sub-line data and is reset whenever a buffering result is latched to the latch and print portion 146. Thus, the reset buffer can buffer (N+1)-th sub-line data that follows the N-th latched sub-line data. In other words, the buffering portion 142 buffers sub-line data one by one using only one buffer.

In order to perform step 70, the line data composition checking portion 144 checks whether all of the N-th sub-line data among the sub-line data has been composed in response to a signal input thereto from the buffering portion 142 and indicating that buffering has been performed and outputs a checking result to the latch and print portion 146 and the control signal generating portion 150, respectively. For example, if it is recognized from the signal input thereto from the buffering portion 142 and indicating that buffering has been performed, the line data composition checking portion 144 checks whether all of the N-th sub-line data has been composed.

In order to perform step 72, when it is recognized from a checking result input from the line data composition checking portion 144 that all of the N-th sub-line data has been composed, the latch and print portion 146 inputs the N-th sub-line data comprised of the buffered critical data from the buffering portion 142 to latch the N-th sub-line data, prints the N-th sub-line data in response to the N-th latched sub-line data, outputs a printing result through an output terminal OUT3, and outputs a signal indicating that printing has been performed to the second printing completion checking portion 148. In this case, the latch and print portion 146 prints critical data in each block included in the N-th sub-line data in response to a strobe signal when printing the N-th latched sub-line data. Thus, the number of strobe signals is the same as the number of blocks included in one main line.

In order to perform step 74, when it is recognized from a signal input from the latch and print portion 146 to the second printing completion checking portion 148 that printing of the N-th sub-line data is completed, the second printing completion checking portion 148 checks whether printing of the m-th main line has been completed and outputs a checking result as a fifth control signal C5 to the control signal generating portion 150.

In order to control the remaining data checking portion 140 to perform steps 62, 64, 66, and 76 shown in FIG. 3, the control signal generating portion 150 outputs the third control signal C3, which is generated in response to the fourth control signal C4 input thereto from the remaining data checking portion 140, the fifth control signal C5 input thereto from the second printing completion checking portion 148 and a checking result input from the line data composition checking portion 144, to the remaining data checking portion 140. For example, if it is recognized from the checking result input from the line data composition checking portion 144 that all of the N-th sub-line data has not been composed, the control signal generating portion 150 generates the third control signal C3 so that the remaining data checking portion 140 increases the variable $B_n$ by 1. In addition, if it is recognized from the fourth control signal C4 input from the remaining data checking portion 140 that a division result is less than or equal to N−1, the control signal generating portion 150 generates the third control signal C3 so that the remaining data checking portion 140 increases the variable $B_n$ by 1 and then performs step 64. In addition, if it is recognized from the fifth control signal C5 input from the second printing completion checking portion 148 that printing of the m-th main line is not completed, the control signal generating portion 150 generates the third control signal C3 so that the remaining data checking portion 140 increases the variable N by 1 to perform step 76, initializes the variable $B_n$ to perform step 62.

Next, in order to perform step 16B shown in FIG. 4, the buffering and printing portion 104A shown in FIG. 7 may further include the variable determination portion 152.

First, in order to perform step 90 shown in FIG. 4, the variable determination portion 152 shown in FIG. 7 initializes the variable $F_n$. For example, if it is recognized from the second control signal C2 input to the remaining data checking portion 140 from the calculation completion checking portion 124 of FIG. 6 that the total amount of data in each of the blocks composing the m-th main line is calculated, the remaining data checking portion 140 initializes N, and the variable determination portion 152 initializes the variable $F_n$. In this case, in order to perform step 98, the variable determination portion 152 determines the last bit number of the N-th critical data in the $B_n$-th block input thereto through the input terminal IN1 as the variable $F_n$ and outputs the determined variable $F_n$ to the buffering portion 142. In addition, in this case, the operation of the buffering portion 142 performing steps 92, 94, and 96 will be described below.

If it is recognized from the fourth control signal C4 input to the buffering portion 142 from the remaining data checking portion 140 that the division result is less than or equal to N−1, in order to perform step 92, the buffering portion 142 buffers bits of the N-th critical data in the $B_n$-th block as 0. However, if it is recognized from the fourth control signal C4 that the division result is greater than N−1, in order to perform step 84, the buffering portion 142 buffers from the first bit number in the $B_n$-th block to the last bit number of the (N−1)-th critical data as 0. In this case, in order to perform step 96, the buffering portion 142 inputs the variable $F_n$ from the variable determination portion 152 and starts buffering of the N-th critical data in the $B_n$-th block from a position indicated by a $(F_n+1)$-th number.

Meanwhile, in order to perform step 18 shown in FIG. 1, when it is recognized in response to a signal input to the first printing completion checking unit 106 from the buffering and printing unit 104 indicating that printing of the m-th main line is completed, the first printing completion checking unit 106 checks whether printing of a unit page has been completed and outputs a checking result as the first control signal C1 to the transfer unit 100. For example, if it is recognized from the fifth control signal C5 input from the second printing completion checking portion 148 shown in FIG. 7 that printing of the m-th main line is completed, the first printing completion checking unit 106 checks whether printing of the unit page has been completed. In this case, if it is recognized from the first control signal C1 input from the first printing completion checking portion 106 that printing of the unit page is not completed, the transfer unit 100 increases the variable m by 1 to perform step 20, drives a line feed motor at a position of the m-th increased main line to transfer a sheet of paper in order to perform step 12.

As described above, in the thermal transfer printing method and apparatus according to an embodiment of the present invention, the maximum instantaneous power consumption is reduced. Conventional thermal transfer printing methods perform printing in a unit of a main line regardless of the amount of data in each block. Thus $dP_U$ is provided as the maximum instantaneous power consumption and the more the amount of data, the more the maximum instantaneous power consumption. By contrast, according to embodiments of the present invention, $N_T P_U$ is provided as the maximum instantaneous power consumption. This is because each main line is divided into several sub-lines, with each sub-line having a maximum number of dots. Thus, the maximum instantaneous power is limited to the maximum number of dots in each sub-line, rather than all of the dots in a main line. As such, the level of maximum instantaneous power consumption is reduced to $P_U(d-N_T)$, a DC power supply unit having low rating can advantageously be used, and the size of the DC power supply unit can be reduced. As a result, a portable thermal transfer printing apparatus, for example, a portable printer, can be conveniently carried, and the rating of a battery commonly used with another apparatus is reduced. In addition, the number $N_T$ of critical dots is adjusted such that a manufacturer of a thermal transfer printing apparatus adjusts the rating of the DC power supply unit or the battery. Further, the number of strobe signals and the size of each block composing a main line are not changed while lowering the rating, so a conventional thermal printhead can be used without any changes thereto.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. A thermal transfer printing method of printing each main line in units of one or more blocks, the method comprising:

(a) uniting a plurality of critical data, which exists in the same order in each of the one or more blocks in each of the main lines composing a unit page, to one another, storing the uniting results as a plurality of sub-line data and printing the plurality of stored sub-line data;

wherein each of the plurality of critical data is data obtained by dividing data included in each of the one or more blocks by the number of critical dots and each of the plurality of critical data has a number of dots less than or equal to the number of critical dots.

2. The method of claim 1, wherein in step (a), all of the sub-line data is stored, and all of the stored sub-line data is sequentially printed one by one.

3. The method of claim 1, wherein in step (a), the sub-line data is printed whenever the sub-line data are stored.

4. The method of claim 1, wherein step (a) comprises:

(a1) initializing a variable m that identifies the main lines;

(a2) transferring a sheet of paper to a position of an m-th main line which is one of the main lines;

(a3) obtaining the number of the critical data included in each of the blocks composing the m-th main line;

(a4) uniting the critical data included in each of the blocks to one another in the same order using the number of the critical data, buffering the uniting result as the sub-line data, and printing the buffered sub-line data;

(a5) determining whether printing of the unit page has been completed; and (a6) if it is determined that printing of the unit page has not been completed, increasing the variable m by 1 and proceeding to step (a2).

5. The method of claim 4, wherein step (a3) comprises:

(a31) initializing a variable n that identifies the blocks composing the m-th main line;

(a32) calculating the amount of data in an n-th block among the blocks;

(a33) dividing the calculated amount of data in the n-th block by the number of critical dots;

(a34) determining whether the total amount of data in the blocks composing the m-th main line has been calculated, and if it is determined that the total amount of data in the blocks has been calculated, proceeding to step (a4); and (a35) if it is determined that the total amount of data in the blocks has not been calculated, increasing the variable n by 1 and proceeding to step (a32);

wherein the number of the critical data corresponds to the lowest number among integer numbers greater than the division result.

6. The method of claim 5, wherein step (a4) comprises:

(a41) initializing a variable N that identifies the plurality of sub-line data;

(a42) initializing a viable $B_n$ that identifies the blocks composing the m-th main line;

(a43) determining whether the division result in step (a33) is greater than N−1;

(a44) increasing the variable $B_n$ by 1 and proceeding to step (a43) if it is determined that the division result in step (a33) is less than or equal to N−1;

(a45) buffering N-th critical data in a $B_n$-th block among the blocks if it is determined that the division result in step (a33) is greater than N−1;

(a46) determining whether all of N-th sub-line data among the sub-line data has been composed, and if it is determined that all pf the N-th sub-line data has not been composed, proceeding to step (a44);

(a47) latching and printing the N-th sub-line data comprised of the buffered critical data if it is determined that all of the N-th sub-line data has been composed;

(a48) determining whether printing of the m-th main line has been completed, and if it is determined that printing of the m-th main line has been completed, proceeding to step (a5); and (a49) increasing the variable N by 1 and proceeding to step (a42) if it is determined that printing of the m-th main line has not been completed.

7. The method of claim 6, wherein step (a4) further comprises:

buffering bits of the N-th critical data in the $B_n$-th block as '0' and proceeding to step (a44) if it is determined that the division result in step (a33) is less than or equal to N−1;

buffering bits from a first bit number in the $B_n$-th block to a last bit number of a (N−1)-th critical data as 0 and proceeding to step (a45) if it is determined that the division result in step (a33) is greater than N−1; and after step (a45), determining a bit number of last data of the N-th critical data in the $B_n$-th block as the variable $F_n$ and proceeding to step (a46);

wherein a bit that does not contribute to thermal transfer corresponds to '0', and in step (a41), the variable $F_n$ is initialized, and in step (a45), buffering of the N-th critical data in the $B_n$-th block starts from a position indicated by a $(F_n+1)$-th number.

8. A thermal transfer printing apparatus for printing each main line in unit of one or more blocks, wherein a plurality of critical data existing in the same order in each of the blocks in each of the main lines composing a unit page are united to one another, the uniting results are stored as a plurality of sub-line data, and the plurality of stored sub-line data are printed, and each of the plurality of critical data is data obtained by dividing data included in each of the blocks by the number of critical dots and each of the plurality of critical data has a number of dots less than or equal to the number of critical dots, wherein the thermal transfer printing apparatus comprises:

a transfer unit, which transfers a sheet of paper to a position of an m-th main line among main lines in response to a first control signal and outputs a signal indicating that the sheet of paper has been transferred;

a number checking unit, which calculates the number of critical data from data which is included in each block among blocks composing the m-th main line in response to the signal indicating that the sheet of paper has been transferred;

a buffering and printing unit, which unites a plurality of critical data included in each of the blocks to one another in the same order using the calculated number of critical data, buffers the uniting results as a plurality of sub-line data, prints the plurality of buffered sub-line data, and outputs a signal indicating that printing has been performed; and a first printing completion checking unit, which checks whether printing of a unit page has been completed in response to the signal indicting that printing has been performed, and outputs a checking result as the first control signal.

9. The apparatus of claim 8, wherein the number checking unit includes:

a data amount calculation portion, which calculates the amount of data in an n-th block among the blocks in response to a second control signal;

a division portion, which divides the calculated amount of data in the n-th block by the number of critical dots; and a calculation completion checking portion, which checks whether the total amount of data in the blocks composing the m-th main line has been calculated, and outputs a checking result as the second control signal;

wherein the buffering and printing unit buffers the plurality of sub-line data in response to the second control signal, and the number of critical data corresponds to the lowest number among integer numbers greater than the division result.

10. The apparatus of claim 9, wherein the buffering and printing unit includes:

a remaining data checking portion, which compares a division result with N−1 (where N is a variable that identifies the sub-line data) in response to the second and third control signals, outputs a comparison result as a fourth control signal, and adjusts a variable $B_n$ in response to the fourth control signal;

a buffering portion, which buffers N-th critical data in a $B_n$-th block among the blocks in response to the fourth control signal and outputs a signal indicating that buffering has been performed;

a line data composition checking portion, which checks whether all of N-th sub-line data among the sub-line data has been composed in response to the signal indicating that buffering has been performed, and outputs a checking result;

a latch and print portion, which latches the N-th sub-line data comprised of the buffered critical data in response to the checking result input from the line data composition checking portion to print the N-th sub-line data and outputs a signal indicting that printing has been performed;

a second printing completion checking portion, which checks whether printing of the m-th main line has been completely performed in response to the signal indicating that printing has been performed, and outputs a checking result as a fifth control signal; and a control signal generating portion, which generates the third control signal in response to the fourth and fifth control signals and a checking result input from the line data composition checking portion;

wherein the first printing completion checking portion checks whether printing of the unit page has been completed in response to the fifth control signal.

11. The apparatus of claim 10, wherein the buffering portion includes first through N'-th (where N' is a maximum number of critical data existing in each of the blocks) buffers, and the N-th ($1 \leqq N \leqq N'$) buffer enabled in response to the fourth control signal buffers N-th critical data in a $B_n$-th block among the blocks.

12. The apparatus of claim 10, wherein the buffering and printing unit further includes a variable determination portion, which determines a bit number of last data of the N-th critical data in the $B_n$-th block as a variable $F_n$ and outputs the determined variable $F_n$, wherein a bit that does not contribute to a thermal transfer corresponds to 0, and the buffering portion buffers all bits in the $B_n$-th block as 0 or buffers bits from a first bit number in the $B_n$-th block to a last bit number of a (N−1)-th critical data as 0 in response to the fourth control signal and starts buffering the N-th critical data in the $B_n$-th block from a position indicated by a $(F_n+1)$-th number.

* * * * *